US006170308B1

(12) United States Patent
Veronesi et al.

(10) Patent No.: US 6,170,308 B1
(45) Date of Patent: Jan. 9, 2001

(54) METHOD FOR PEENING THE INTERNAL SURFACE OF A HOLLOW PART

(75) Inventors: William A. Veronesi, Hartford; Pedro Sainz de Baranda, Farmington; Vincent C. Nardone, South Windsor; Stephen E. Tolman, Vernon, all of CT (US); Paul H. Wawrzonek, Bondsville, MA (US)

(73) Assignee: United Technologies Corporation, Hartford, CT (US)

( * ) Notice: Under 35 U.S.C. 154(b), the term of this patent shall be extended for 0 days.

(21) Appl. No.: 09/357,260

(22) Filed: Jul. 20, 1999

(51) Int. Cl.[7] ..... B21D 26/14; B24C 1/00

(52) U.S. Cl. ..... 72/53; 72/430; 72/707; 29/90.7

(58) Field of Search ..... 72/53, 430, 707; 29/90.7; 451/38

(56) References Cited

U.S. PATENT DOCUMENTS

| | | | | |
|---|---|---|---|---|
| 2,460,657 | | 2/1949 | Robinson | 29/90 |
| 3,675,452 | * | 7/1972 | Osmolovsky et al. | 72/53 |
| 4,354,371 | | 10/1982 | Johnson | 72/53 |
| 5,443,201 | | 8/1995 | Cartry | 228/119 |
| 5,509,286 | | 4/1996 | Coulon | 72/53 |
| 5,829,116 | * | 11/1998 | Vilon | 72/53 |
| 5,950,470 | * | 9/1999 | Prewo et al. | 72/53 |

FOREIGN PATENT DOCUMENTS

| | | |
|---|---|---|
| 0456704 | 1/1975 | (RU) . |
| 1148765 | 4/1985 | (RU) . |
| 1435627 A1 | 11/1988 | (RU) . |
| 1447888 A1 | 12/1988 | (RU) . |
| 1765207 A1 | 9/1992 | (RU) . |
| WO 93/20247 A1 | 10/1993 | (WO) . |

* cited by examiner

*Primary Examiner*—David Jones
(74) *Attorney, Agent, or Firm*—Brian D. Lefort

(57) ABSTRACT

The rate of impact between the peening elements and an internal surface of a hollow part is a function of the vibration frequency, and there is a cut-off frequency at which a hollow part can vibrate and induce repeated impact between its internal surface and the peening elements because the rate of impact becomes erratic and loses its cyclical nature as the vibration frequency deviates from the cut-off frequency. The present invention provides a method for determining the cut-off frequency at which a hollow part can vibrate and maintain the repetitive nature of the impact between its internal surface and the peening elements. Such a method requires a peening element speed limit ratio, which is the ratio of the velocity of the hollow part compared to the velocity of the peening element above which the rate of impact begins to become erratic and lose its cyclical nature. The present invention utilizes the peening element speed limit ratio to determine the frequency at which to vibrate the hollow part when peening its internal surface so as to and maintain repeated impact between it and the peening elements.

32 Claims, 12 Drawing Sheets

METHOD FOR PEENING THE INTERNAL SURFACE OF A HOLLOW PART

CROSS REFERENCE TO RELATED APPLICATIONS

Copending U.S. patent application, Ser. No. 09/357,178, entitled "Method for Determining a Peening Element Speed Limit Ratio When Peening the Internal Surface of a Hollow Part", filed contemporaneously herewith, contains subject matter related to the disclosure herein.

TECHNICAL FIELD

This invention relates to peening and particularly to peening the internal surface of a hollow part and more particularly to a method for determining a peening element speed limit ratio.

BACKGROUND ART

Most metal parts operate in an environment which eventually leads to corrosion or the creation of stress induced cracks, thereby reducing the useful life of such parts. It is known that peening the surface of metal parts can induce compressive residual surface stresses, thereby increasing the resistance of the part to fatigue, cracking and corrosion. Numerous methods exist which relate to peening the exterior surface of metal parts. These methods, however, are not applicable to peening the internal surface of hollow parts because such methods fail to take into account the peculiar difficulties associated with peening the internal surface.

U.S. Pat. No. 2,460,657 addressed some of the distinctive characteristics associated with peening the internal surface of a hollow part. Specifically, that patent taught that vibrating the hollow part produces repeated impact between the peening elements and the internal surface of the hollow part. Additionally, U.S. Pat. No. 2,460,657 suggested that the peening elements' vibratory motion is largely determined by their own natural frequency, but that patent does not indicate at which frequency the hollow part must vibrate in order to induce the desired residual stresses on the internal surface of a hollow part. In order to induce compressive residual stresses, the peening elements must contact the internal surface at certain velocities. The prior art, however, fails to teach one how to determine the vibration frequency and acceleration at which the hollow part must vibrate in order to cause the peening elements to contact the internal surface at such desired velocities. Specifically, the devices used to vibrate parts, such as shaker tables, typically have two controllers, namely a frequency controller and an acceleration controller to control its vibrational movement. The frequency controller sets the shaker table's vibration frequency ($\omega$), and the acceleration controller sets the maximum sinusoidal acceleration (a). It should be understood that if the vibration frequency is known, then the acceleration can be replaced by vibration amplitude (A) because acceleration is equal to the product of the vibration amplitude and the square of the frequency (i.e., $a = \omega^2 A$). Hence, acceleration and vibration amplitude are interchangeable, but for the purposes of this invention, the inventor shall consistently refer to acceleration rather than amplitude because the devices used to vibrate parts typically refer to acceleration rather than amplitude. It should also be understood, that as the hollow part vibrates, its instantaneous acceleration changes, but the maximum acceleration remains constant, which is hereinafter referred to as the "constant sinusoidal acceleration."

Furthermore, U.S. Pat. No. 2,460,657 indicated that the frequency of the impact between the peening elements and the hollow part should be out of step with the vibration frequency at which to vibrate the hollow part. That patent, however, did not teach how to determine or calculate the acceleration at which to vibrate the hollow part in order to produce a maximum impact rate between the peening elements and the hollow part wherein the impact rate is the rate of impact between the peening element(s) and the hollow part. Moreover, U.S. Pat. No. 2,460,657 indicated that the impact rate is determined by the peening elements own natural frequency of vibration, which is a function of the relative proportions of the peening element(s) and the hollow part, as well as their material, thereby suggesting that one could alter the proportion and material of the peening elements to change the rate of impact between the peening elements and the hollow part.

Variables other than the natural frequency of vibration and proportion and material of the peening elements may also affect the impact rate of the peening elements and the hollow part. Such other variables may include the cavity height of the hollow part and the acceleration and velocity of the hollow part. What is needed is a method for establishing a relationship between these multiple variables in order to identify the optimum frequency at which to vibrate a hollow part.

DISCLOSURE OF INVENTION

The inventors of the present invention have discovered that the rate of impact between the peening elements and an internal surface of a hollow part is a function of the vibration frequency, which is the frequency at which the hollow part vibrates, and not only a function of the peening elements' natural frequency. Unlike U.S. Pat. No. 2,460,657, which implies that there will be repeated impact as long as the peening elements vibrate out of step with the hollow part, the inventors of the present invention have realized that there are limits at which the hollow part can vibrate and sustain repeated (i.e., cyclical) impact between the peening elements and the hollow part. "Repeated impact" means that the peening elements repeatedly contact the hollow part at the same frequency as the hollow part's vibration frequency even though the repeated contact may be out of phase with the vibration frequency. The inventors of the present invention have, therefore, discovered that there is a cut-off frequency at which a hollow part can vibrate and induce repeated impact between its internal surface and the peening elements because the rate of impact becomes erratic and loses its cyclical nature as the vibration frequency deviates from the cut-off frequency.

It is an object of the present invention to provide a method for determining the cut-off frequency at which a hollow part can vibrate and maintain the repetitive nature of the impact between its internal surface and the peening elements.

It is a further object of the present invention to provide a method for determining a peening element speed limit ratio ($\gamma$) (hereinafter referred to as "speed limit ratio"). The peening element speed limit ratio is the ratio of the velocity of the hollow part compared to the velocity of the peening element above which the rate of impact begins to become erratic and lose its cyclical nature.

It is still a further object of the present invention to utilize the speed limit ratio to calculate the acceleration at which to vibrate a hollow part when peening its internal surface. The velocity at which the peening element must impact the internal surface of the hollow part to induce certain compressive residual surface stresses is known. However, it is not known at which sinusoidal acceleration to vibrate the hollow part to cause the peening element to attain such a velocity. Developing a speed limit ratio provides an operator of a peening apparatus, such as a shaker, with the necessary sinusoidal acceleration at which to vibrate the hollow part, thereby causing the inducement of the desired compressive residual surface stresses.

According to the present invention, there is provided a method for determining the cut-off frequency at which to vibrate a hollow part when peening its surface by inserting a peening element into the hollow part, vibrating the hollow part until the peening element impacts the internal surface of the hollow part at a repetitive rate and altering the vibration frequency until the rate of impact between the peening element and internal surface is less than the vibration frequency.

An alternate method of the present invention includes using the cut-off frequency to determine the speed limit ratio for that particular hollow part. Determining the speed limit ratio includes inserting a peening element into a hollow part, vibrating the hollow part at a constant sinusoidal acceleration while varying the vibration frequency until the peening element impacts the internal surface of the hollow part at a rate equal to the vibration frequency. Upon matching the impact rate to the vibration frequency, the vibration frequency is further altered until the impact rate begins to decrease or fall below the vibration frequency. The cut-off frequency is the vibration frequency just prior to when the impact rate begins to decrease or fall below the vibration frequency. Both the velocity of the hollow part and the velocity of the peening element are determined when the hollow part vibrates at the cut-off frequency. The hollow part, thereafter, vibrates at a second constant sinusoidal acceleration, and the above process is repeated to determine the second hollow part velocity and second peening element velocity at the second cut-off frequency. The speed limit ratio ($\gamma$) is then calculated by dividing the difference between the first and second peening element velocities by the difference between the first and second hollow part velocities. Additional, peening element velocities and hollow part velocities could also be determined by the above mentioned process to calculate the speed limit ratio.

A further embodiment of the present invention includes using the speed ratio to calculate the coefficient of restitution ($\epsilon$) which is equal to approximately $(\gamma-1)/(\gamma+1)$.

A still further embodiment of the present invention includes using the speed limit ratio to calculate the acceleration of the hollow part when peening its internal surface. Specifically, a method for peening the internal surface of a hollow part includes the steps of inserting a peening element, having a diameter (d), into the cavity of the hollow part, having a cavity height (h), vibrating the hollow part at a vibration frequency equal to about $$\frac{V_p}{2(h-d)}$$

and an acceleration equal to or greater than about $$\frac{\pi V_p^2}{\gamma(h-d)},$$

wherein $V_p$ is the desired velocity of the peening element to induce the desired compressive residual stress and wherein $\gamma$ is the speed limit ratio. The speed limit ratio provides an operator of a peening apparatus with the relationship between the acceleration of the peening apparatus and the desired velocity of the peening element to induce the desired compressive residual stress.

The foregoing objects, features and advantages of the present invention will become more apparent in light of the following detailed description of exemplary embodiments thereof as illustrated in the accompanying drawings.

BEST MODE FOR CARRYING OUT THE INVENTION

Figure 1:
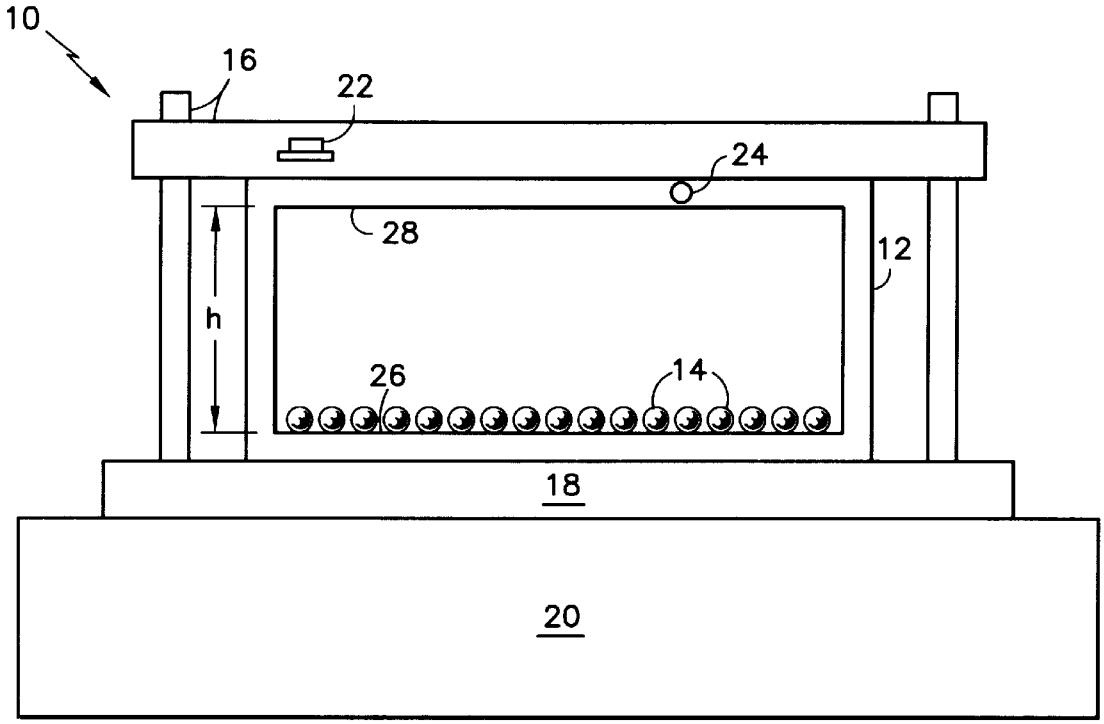
FIG. 1 is a peening apparatus to peen the internal surface of a hollow part.

Referring to FIG. 1, there is shown a peening apparatus 10 that includes a hollow part 12 affixed to a shaker 20, preferably to the shaker top 18, by a clamp 16. Also, included in the hollow part 12 are a plurality of peening elements 14, which rest on the internal bottom surface 26 of the hollow part 12. Although the hollow part 12 can be constructed of a variety of materials and shapes, the hollow part 12 in the instant case, is a portion of square tubing capped with clear acrylic plating, thereby allowing an observer to view the movement of the peening elements 14 within the hollow part.

Figure 2:
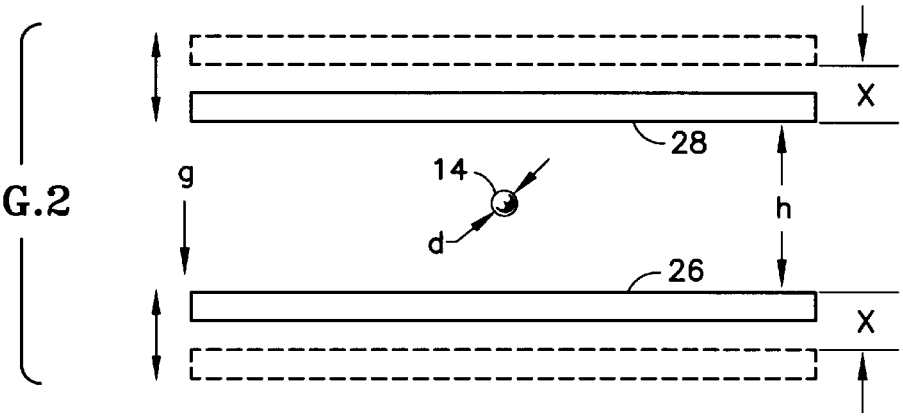
FIG. 2 is an illustration of a one-dimensional model of the peening apparatus illustrated in FIG. 1.

Referring to FIG. 2, there is shown an illustration of a one-dimensional mathematical model that simulates the movement of the elements of the peening apparatus illustrated in FIG. 1. The mathematical model comprises a peening element 14 located between the top internal surface 28 and bottom internal surface 26 of a hollow part 12 having a fixed cavity height (h). As the hollow part 12 vibrates at a vibration frequency (f), in the form of a sinusoidal oscillation, the mathematical model tracks the vertical movement and velocity of the top internal surface 28, bottom internal surface 26 and peening element 14 as a function of time.

The formula for tracking the vertical movement of the peening element 14 is as follows:

$$X_{pe}=V_i t-gt^2/2+X_o \quad \text{[Eq. 1]}$$

where, t=time

Xpe=the peening element's position at time t $V_i$=the peening element's velocity at any instant g=the acceleration of gravity $X_o$=the peening element's position at time t=0

The formula for determining the velocity of the peening element 14 is as follows:

$$V_{pe}=V_i-gt \quad \text{[Eq. 2]}$$

where, t=time $V_{pe}$=the peening element's velocity at time t $V_i$=the peening element's velocity at any instant Eq. 2 can be used to determine the velocity of the peening element 14 just prior to impacting the top or bottom internal surfaces 26, 28, but the velocity of the peening element 14 after impacting such surfaces must account for the loss of energy due to such a collision. A means of accounting for such an energy loss is the coefficient of restitution ($\epsilon$), which is the ratio of difference between the peening element's velocity just after impact and the velocity of the hollow part compared to the difference between the peening element's velocity immediately after impact and the velocity of the hollow part. Therefore, the velocity of the peening element just after impact is as follows:

$$V_{pe}'=V_p(1+\epsilon)-\epsilon V_{pe} \quad \text{[Eq. 3]}$$

where $V_{pe}'$=the peening element's velocity just after impact $V_p$=the velocity of the hollow part $V_{pe}$=the peening element's velocity just prior to impact $\epsilon$=coefficient of restitution, which was determined experimentally by measuring the height of the peening element after it bounced from being dropped The velocity of the peening element 14 for the time it is between contacting the top and bottom internal surfaces 26, 28 can be determined by replacing $V_i$ in Eq. 2 ith $V_{pe}'$ in Eq. 3.

The formula for tracking the vertical movement of the top internal surface 28 is as follows:

$$X_t=A\cos(\omega t+\Phi) \quad \text{[Eq. 4]}$$

where,

A=vibration amplitude $X_t$=location of the top surface of the hollow part $\omega$=vibration frequency, wherein $\omega=2\pi f$ t=time $\Phi$=phase angle at t=0

The formula for tracking the vertical movement of the bottom internal surface 26 is similar to the formula for tracking the movement of the top internal surface 28 but takes into consideration that the coordinate of the bottom internal surface 26 is below the top surface at a distance equal to the cavity height (h). Therefore, the formula for tracking the movement of the bottom internal surface 26 of the hollow part ($X_b$) is as follows:

$$X_b=A\cos(\omega t+\Phi)-h \quad \text{[Eq. 5]}$$

The formulas for determining the velocities of the top and bottom internal surfaces 26, 28 are the same because both surfaces move simultaneously with each other, assuming that they are connected, and are as follows:

$$V_p=\omega A\sin(\omega t+\Phi) \quad \text{[Eq. 6]}$$

where, $V_p$=the velocity of the hollow part at time t

Reducing the cavity height (h) by the diameter (d) of the peening element and treating the peening element as a point, the vertical movement of the peening element is equal to the vertical movement of the top and bottom surfaces at the time the peening element contacts each surface. Equating Eq. 1 to both Eq. 4 and Eq. 5 and solving for the time (t) yields the times at which the peening element will contact the top and bottom surfaces. Upon solving for the time variable (t) and inserting it into Eq. 1, Eq. 4 and Eq. 5, the vertical movement of the peening element and the top and bottom surfaces, at such times, can be plotted by connecting the times at which the peening element contacts each surface, thereby producing the rate of impact between the peening element and the hollow part. Furthermore, by solving Eq. 2 and Eq. 6 at these times (t), the velocities of the peening element and the hollow part can also be plotted.

Figure 3:
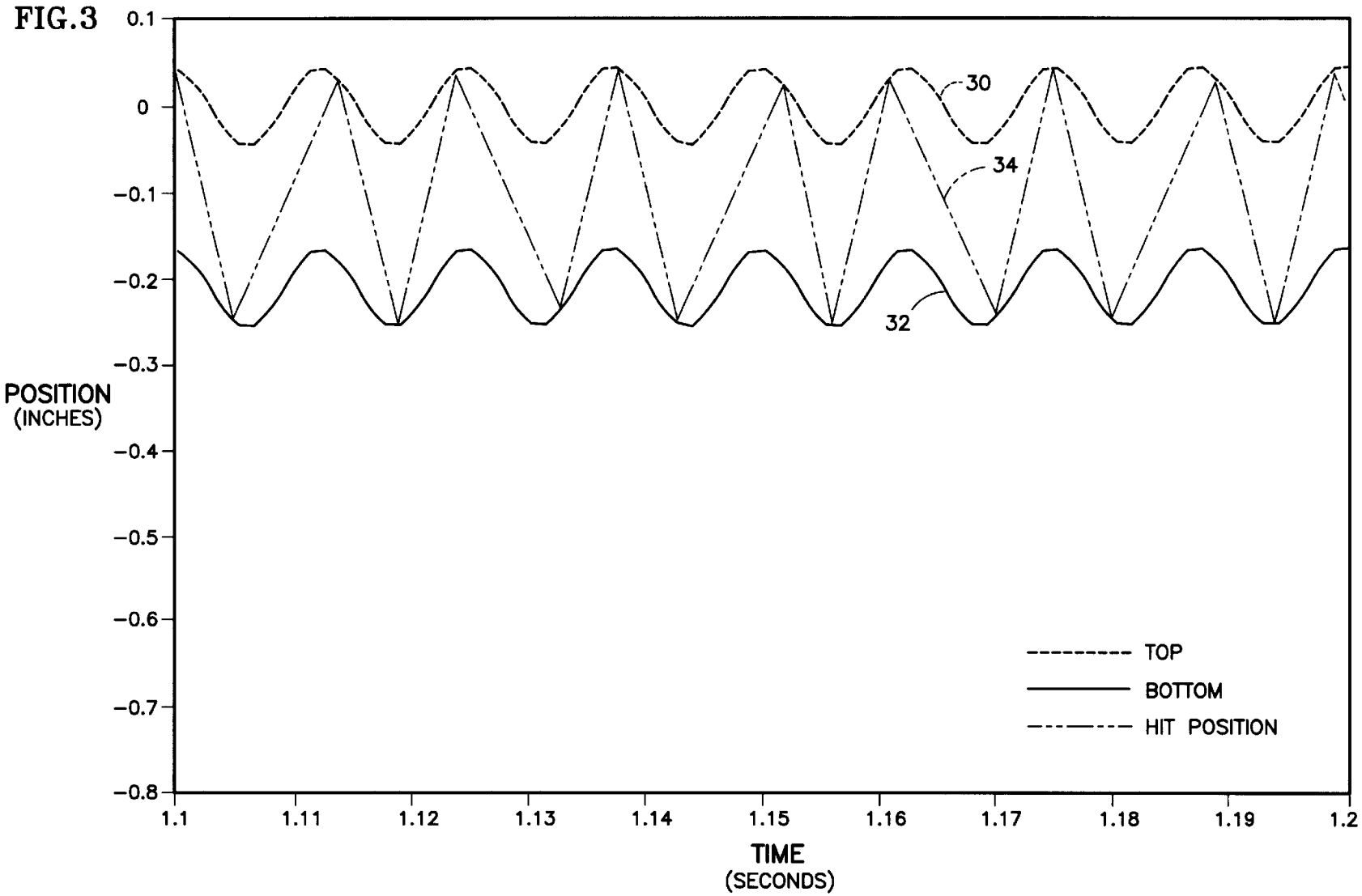
FIG. 3 is a graphical representation of the modeling results illustrating the position of the peening element and the position of the hollow part's top and bottom surfaces as a function of time while the hollow part, having a cavity height of 0.25 inches, vibrates at a frequency equal to 80 Hz and an acceleration equal to 30 gs.

Referring to FIG. 3, there is shown the vertical movement of the top internal surface 28, bottom internal surface 26 and peening element 14 as a function of time on a single plot. Line 30 is indicative of the vertical movement of the top internal surface 28. Line 32 is indicative of the vertical movement of the bottom internal surface 26. Line 34 is indicative of the vertical movement of the peening element 14. FIG. 3 illustrates that when the cavity height (h) is equal to 0.25 inches and the diameter (d) of the peening element is equal to 0.04 inches and the vibration frequency (f) is equal to 80 Hz and the acceleration is equal to 30 gs, wherein one (1) G is equal to the acceleration of gravity, then the peening element 14 contacts both the top internal surface 28 and the bottom internal surface 26 in one vibration cycle. When the peening element 14 contacts both the top internal surface 28 and the bottom internal surface 26 in one vibration cycle, the peening element 14 is said to impact the internal surface(s) of the hollow part 12 at a rate equal to the vibration frequency. Therefore, the peening element 14 will travel twice the distance of the cavity height (h) in one vibration cycle when the peening element 14 impacts the internal surface(s) of the hollow part 12 at a rate equal to the vibration frequency.

As mentioned hereinbefore, maximum acceleration of the hollow part can also be expressed in terms of vibration amplitude. Specifically, the relationship between the two is as follows:

$$a=\omega^2 A \qquad \text{[Eq. 7]}$$

where, a=maximum acceleration $\omega$=vibration frequency, where $\omega=2\pi f$ A=vibration amplitude Therefore, given a constant sinusoidal acceleration and a variable vibration frequency, the vibration amplitude must vary inversely to the vibration frequency.

Figure 4:
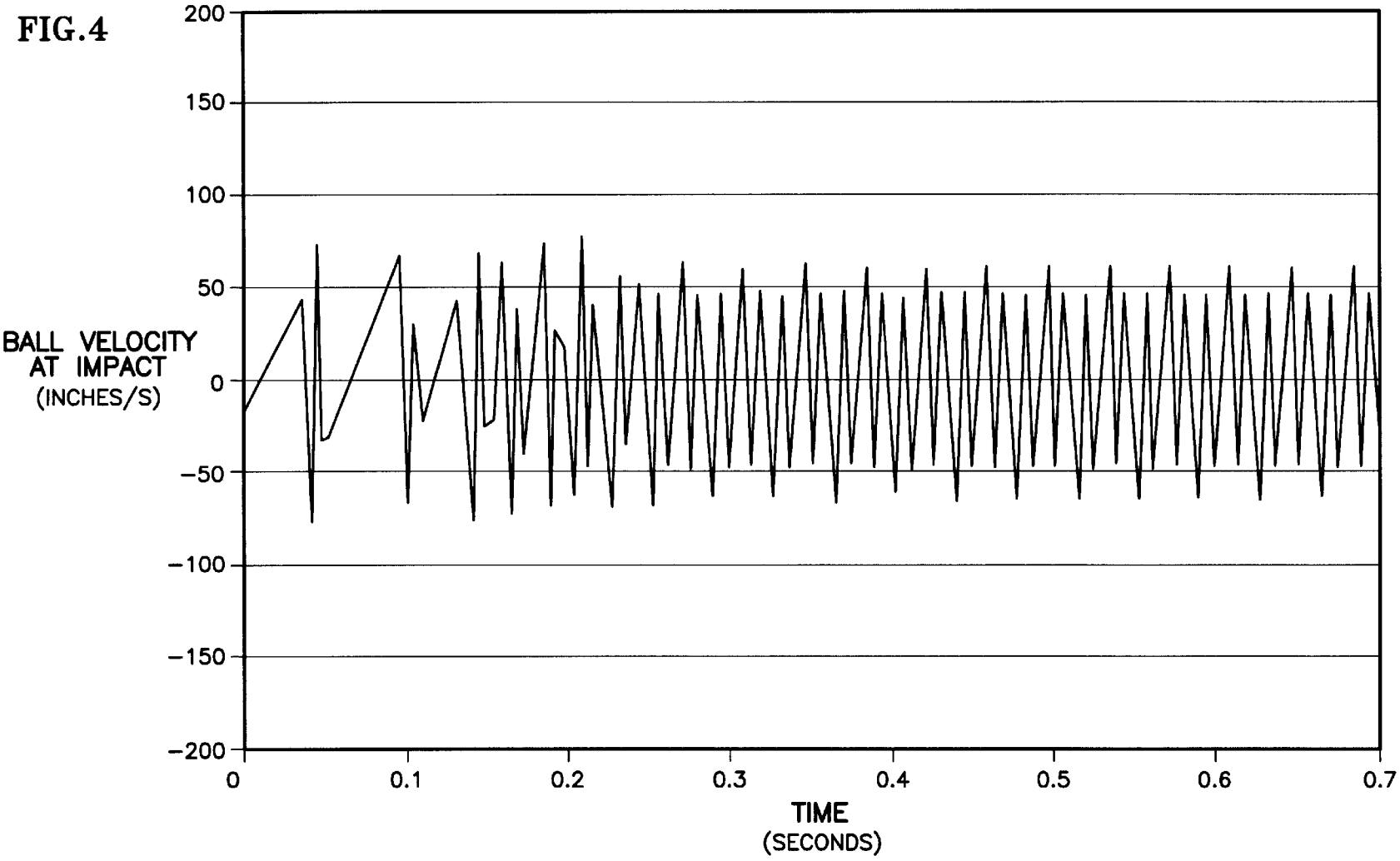
FIG. 4 is a graphical representation of the modeling results illustrating the velocity of the peening element as a function of time while the hollow part, having a cavity height of 0.25 inches, vibrates at a frequency equal to 80 Hz and an acceleration equal to 30 gs.

Referring to FIG. 4, there is shown a plot illustrating the velocity of the peening element 14 as a function of time for the parameters discussed in reference to FIG. 3 above. This figure demonstrates that the peening element 14 fails to contact the top internal surface 28 and the bottom internal surface 26 at a rate equal to the vibration frequency until about 0.5 seconds after the hollow part 12 begins to vibrate because until that time, the peening element 14 contacts such surfaces at an erratic rate. FIG. 4 also illustrates that vibrating a hollow part 12 having a cavity height (h) of 0.25 inches at a vibration frequency equal to 80 Hz and an acceleration equal to 30 gs causes a 0.04 inch diameter peening element 14 to achieve a maximum velocity of about 45 inches/second within the hollow part 12. FIG. 4 through FIG. 11 was generated using a coefficient of restitution equal to about 0.9.

Figure 5:
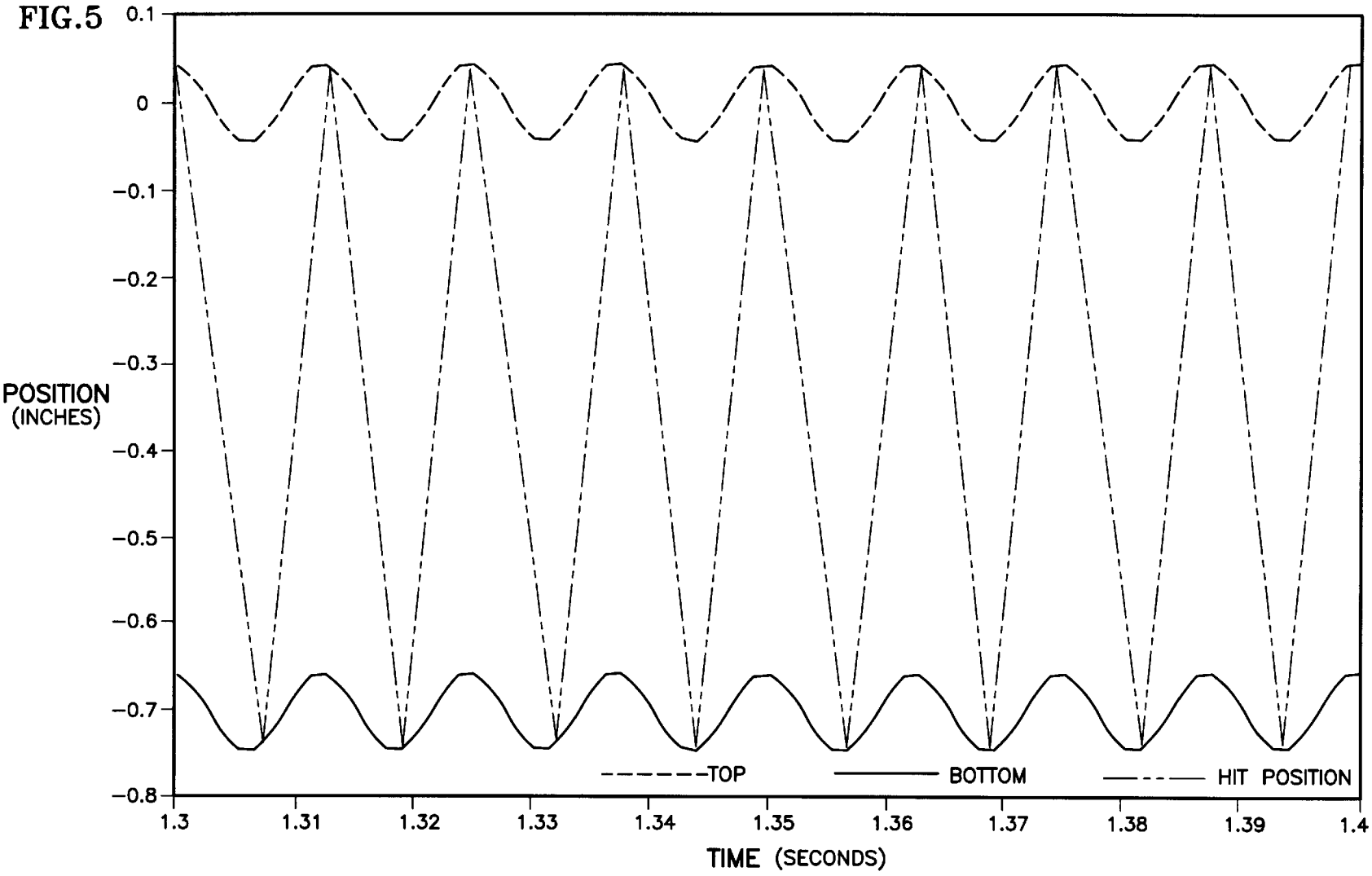
FIG. 5 is a graphical representation of the modeling results illustrating the position of the peening element and the position of the hollow part's top and bottom surfaces as a function of time while the hollow part, having a cavity height of 0.75 inches, vibrates at a frequency equal to 80 Hz and an acceleration equal to 30 gs.

Referring to FIG. 5, there is shown the vertical movement of the top internal surface 28, bottom internal surface 26 and peening element 14 as a function of time on a single plot for another set of parameters. In this instance, the only parameter changed in comparison to FIG. 3 is the cavity height, which increased to 0.75 inches from 0.25 inches. Therefore, the diameter (d) of the peening element, the vibration frequency and the acceleration remained 0.04 inches, 80 Hz and 30 gs, respectively. When subjected to these parameters the peening element 14 impacted the internal surface(s) of the hollow part 12 at a rate equal to the vibration frequency because the peening element 14 contacted both the top internal surface 28 and the bottom internal surface 26 in one vibration cycle.

Figure 6:
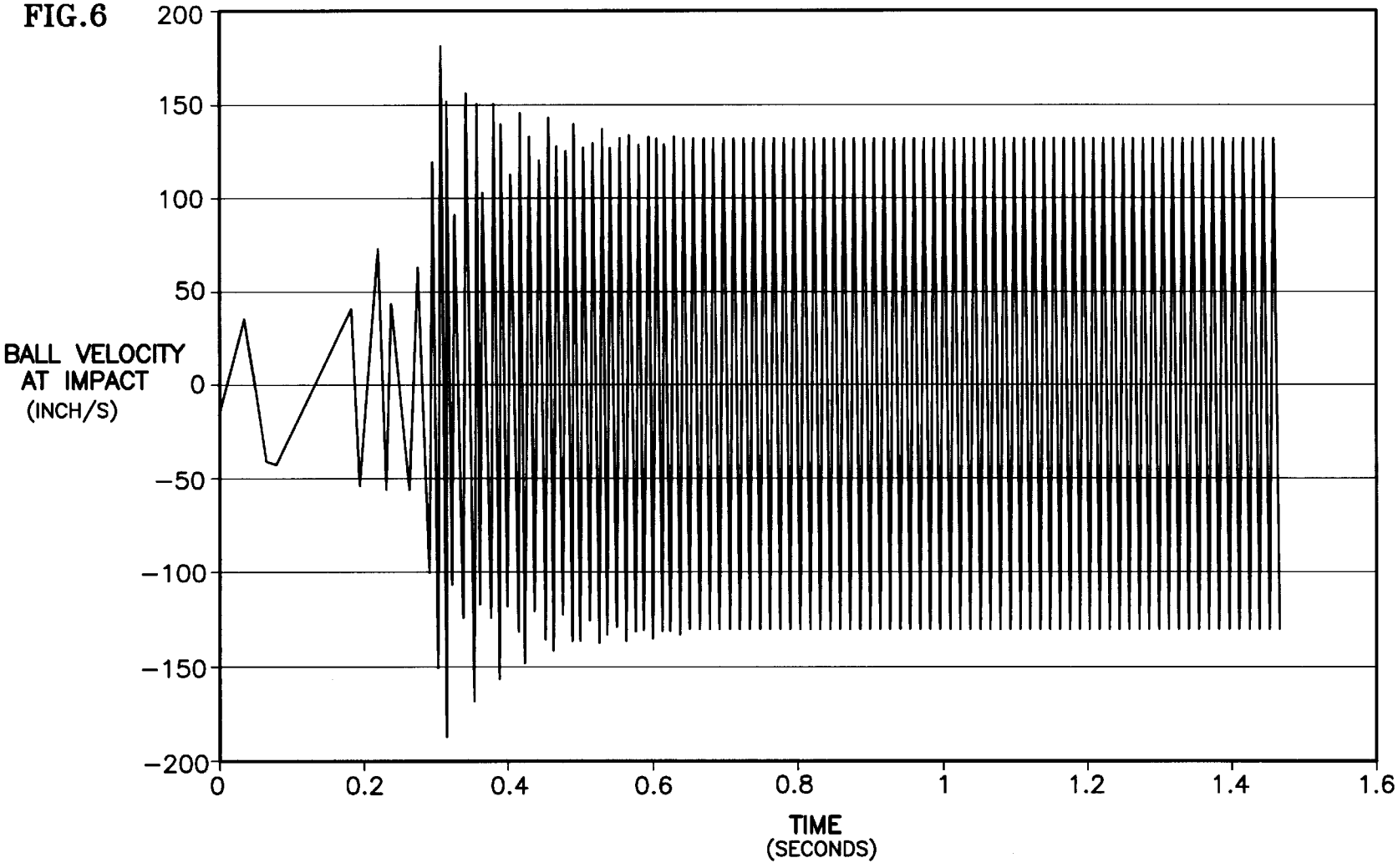
FIG. 6 is a graphical representation of the modeling results illustrating the velocity of the peening element as a function of time while the hollow part, having a cavity height of 0.75 inches, vibrates at a frequency equal to 80 Hz and an acceleration equal to 30 gs.

Referring to FIG. 6, there is shown a plot illustrating the velocity of the peening element 14 as a function of time for the parameters discussed in reference to FIG. 5 above. FIG. 6 demonstrates that the peening element 14 fails to contact the top internal surface 28 and the bottom internal surface 26 at a rate equal to the vibration frequency until about 0.7 to about 0.9 seconds after the hollow part 12 begins to vibrate because until that time, the peening element 14 contacts such surfaces at an erratic rate. According to FIGS. 3 and 4, when the cavity height was 0.25 inches and all other parameters remained unchanged, however, it took about 0.5 seconds for the peening element 14 to contact the internal surface(s) at a periodic rate. Therefore, it takes a longer period of time for the peening element 14 to impact the internal surface(s) as the cavity height increases.

FIG. 6 also illustrates that vibrating a hollow part 12 having a cavity height (h) of 0.75 inches at a vibration frequency equal to 80 Hz and an acceleration equal to 30 gs causes a 0.04 inch diameter peening element 14 to achieve a maximum velocity of about 129 inches/sec. With a reduced cavity height of 0.25 inches, however, the peening element 14 achieves a maximum velocity of about 45 inches/sec, which is approximately one-third (⅓) of the peening element's velocity with a cavity height of 0.75 inches. Therefore, there is a direct relationship between the cavity height and the peening element velocity.

Figure 7:
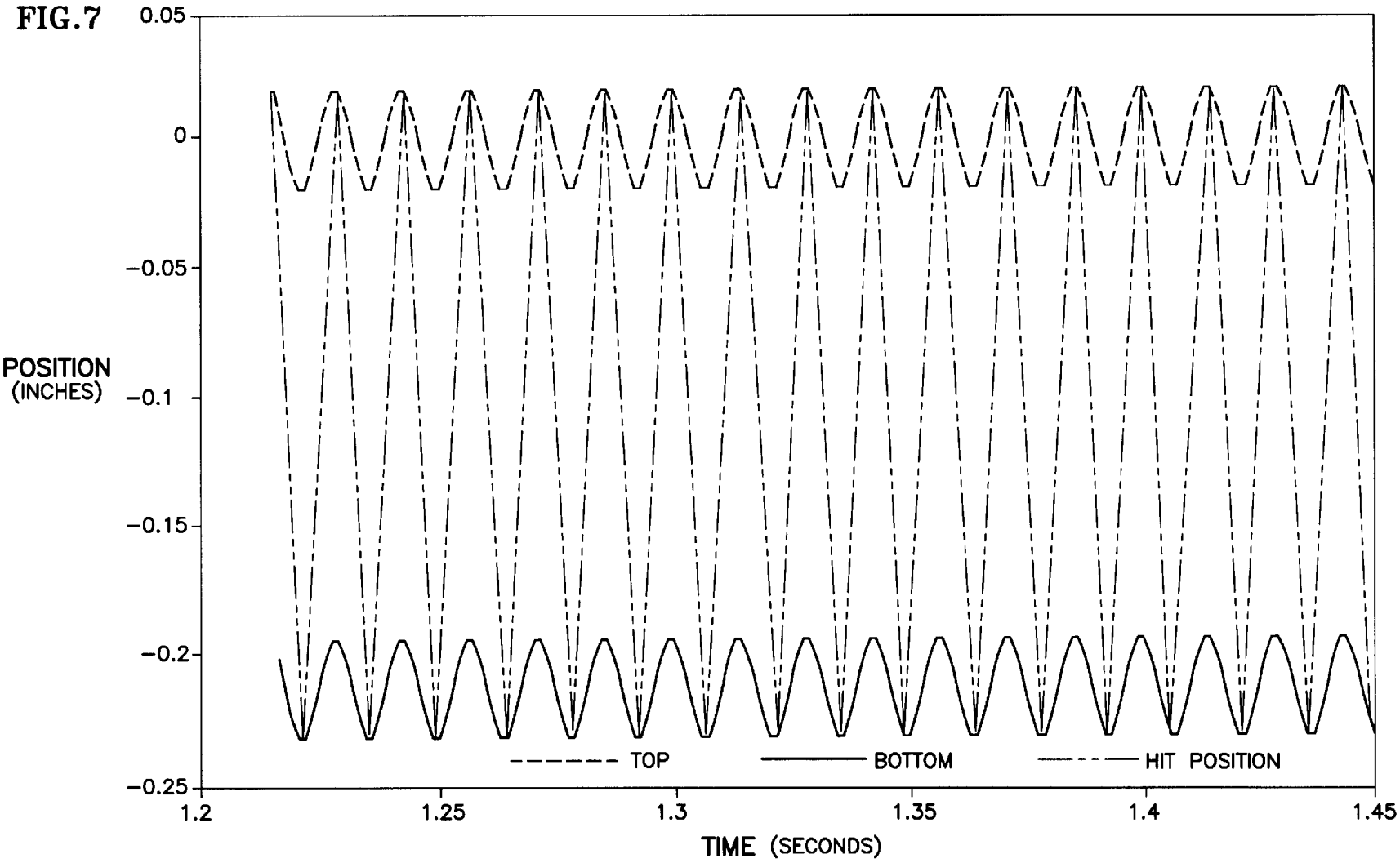
FIG. 7 is a graphical representation of the modeling results illustrating the position of the peening element and the position of the hollow part's top and bottom surfaces as a function of time while the hollow part, having a cavity height of 0.25 inches, vibrates at a frequency equal to 70 Hz and an acceleration equal to 10 gs.
Figure 8:
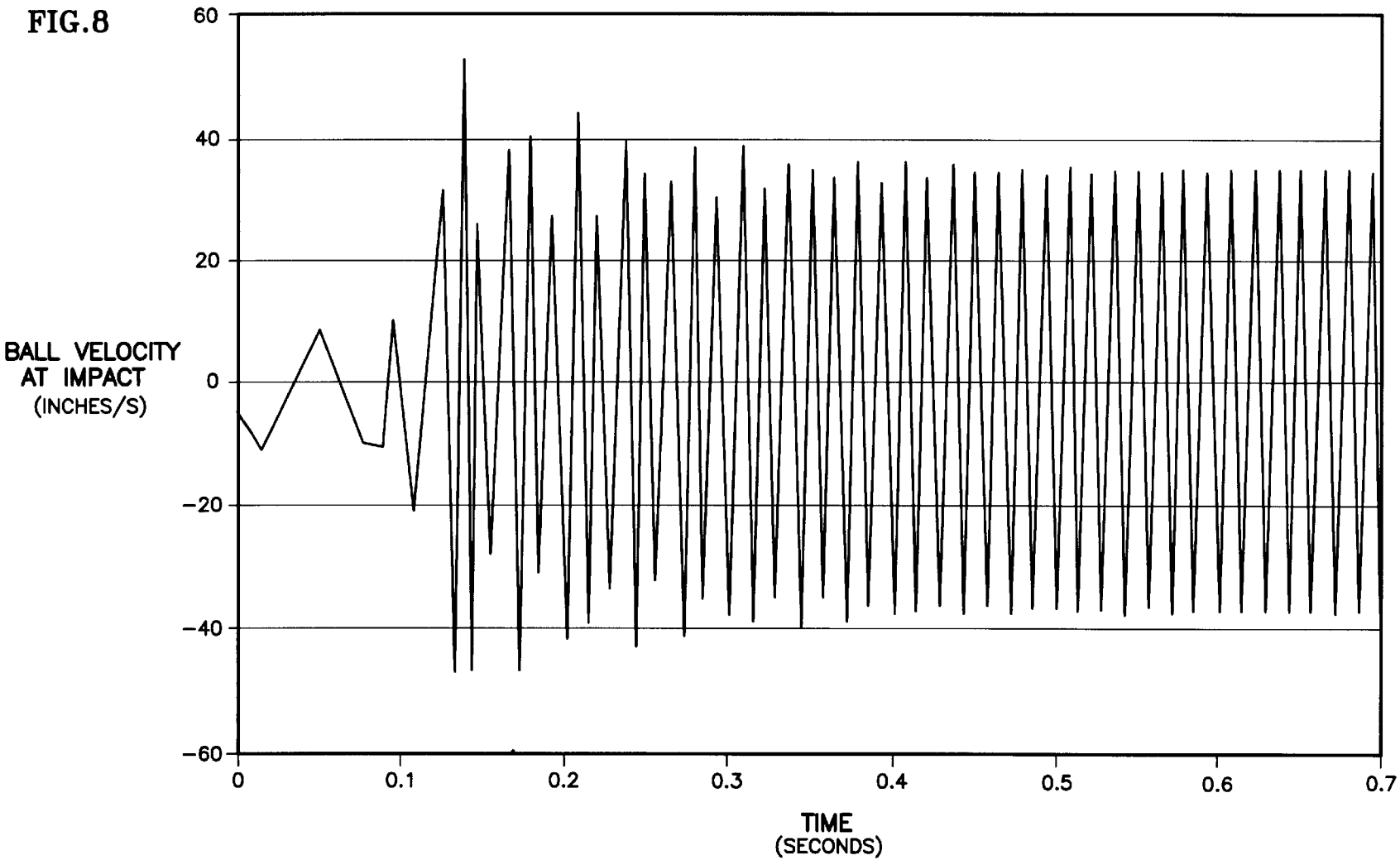
FIG. 8 is a graphical representation of the modeling results illustrating the velocity of the peening element as a function of time while the hollow part, having a cavity height of 0.25 inches, vibrates at a frequency equal to 70 Hz and an acceleration equal to 10 gs.

Referring to FIG. 7, there is shown the vertical movement of the top surface 28, bottom surface 26 and peening element 14 as a function of time on a single plot for a further set of parameters that include a cavity height equal to 0.25 inches, the diameter (d) of the peening element equal to 0.04 inches, the vibration frequency equal to 70 Hz and the acceleration equal to 10 gs. FIG. 8, in turn, illustrates the velocity of the peening element 14 as a function of time for the parameters discussed in reference to FIG. 7. Both FIG. 7 and FIG. 8 demonstrate that when the hollow part 12 is subjected to these parameters, the peening element 14 impacts the internal surface(s) of the hollow part 12 at a rate equal to the vibration frequency. In comparing the parameters of FIGS. 7 & 8 to the parameters of FIGS. 3 & 4, FIGS. 3 & 4 had a vibration frequency of 80 Hz and an acceleration of 30 gs, and FIGS. 7 & 8 had a vibration frequency of 70 Hz and an acceleration of 10 gs. Both sets of figures, however, had the same cavity height of 0.25 inches, and both sets of figures demonstrated impact between the peening element 14 and the internal surfaces(s) at a rate equal to the vibration frequency.

Figure 9:
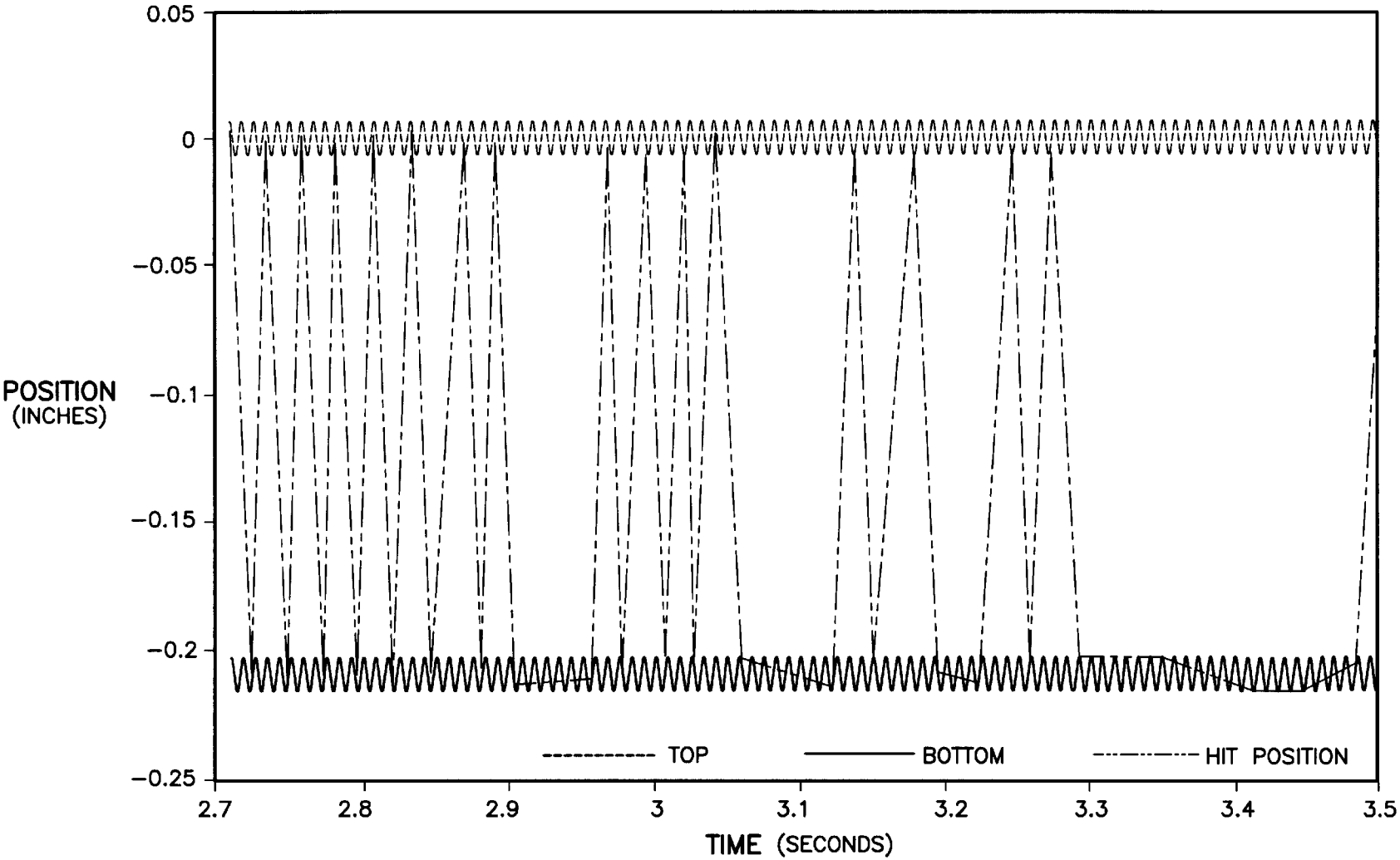
FIG. 9 is a graphical representation of the modeling results illustrating the position of the peening element and the position of the hollow part's top and bottom surfaces as a function of time while the hollow part, having a cavity height of 0.25 inches, vibrates at a frequency equal to 120 Hz and an acceleration equal to 10 gs.
Figure 10:
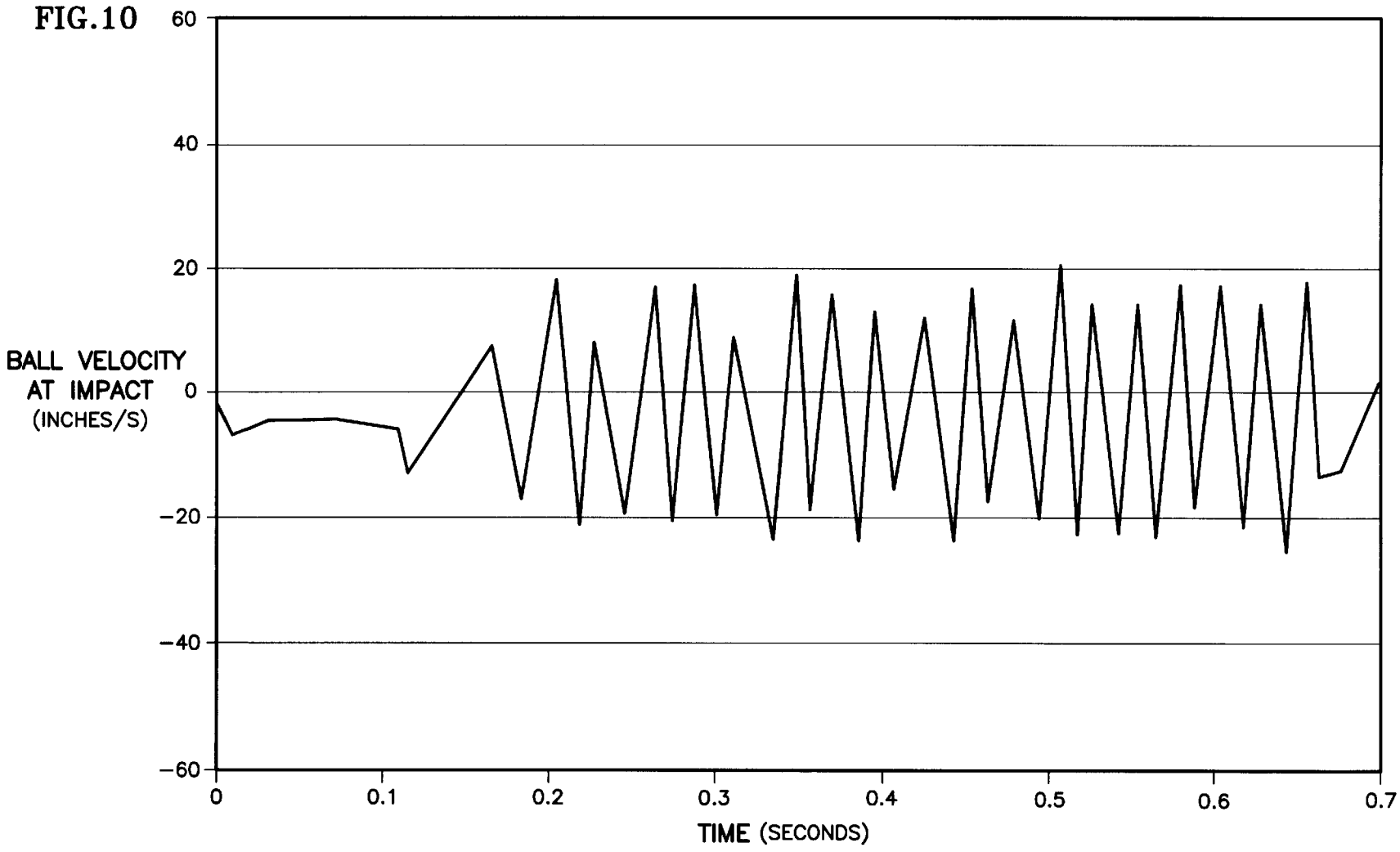
FIG. 10 is a graphical representation of the modeling results illustrating the velocity of the peening element as a function of time while the hollow part, having a cavity height of 0.25 inches, vibrates at a frequency equal to 120 Hz and an acceleration equal to 10 gs.

Referring to FIG. 9, there is shown the vertical movement of the top surface 28, bottom surface 26 and peening element 14 as a function of time on a single plot for an even further set of parameters. In this instance, the only parameter that changed in comparison to FIG. 7 is the vibration frequency (f), which increased from 70 Hz to 120 Hz. Therefore, the cavity height (h), the diameter (d) of the peening element and the acceleration remained 0.25 inches, 0.04 inches, and 10 gs, respectively. In this instance, the peening element 14 failed to impact the top and bottom surfaces 28, 26 at a rate equal to the vibration frequency. FIG. 10, which is a plot illustrating the velocity of the peening element 14 as a function of time for the parameters discussed in reference to FIG. 9, demonstrates that if the peening element 14 fails to impact the internal surface at a periodic rate the velocity of the peening element 14 fails to achieve a maximum velocity at a regular interval.

The inventors of the present invention, therefore, discovered that there is a maximum vibration frequency at which the hollow part 12 can vibrate and attain or sustain impact between the peening element 14 and the internal surface(s) for a given cavity height and peening element diameter. Such maximum vibration frequency is referred to as the cut-off frequency. The cut-off frequency could also refer to the minimum frequency at which a hollow part can vibrate and create repeated impact at a rate equal to the vibration frequency. Continuing to compare FIGS. 7 and 8 to FIGS. 9 and 10, the cut-off frequency for a hollow part having a cavity height equal to 0.25 inches being peened by a peening element having a 0.04 inch diameter is between 70 Hz and 120 Hz.

Figure 11:
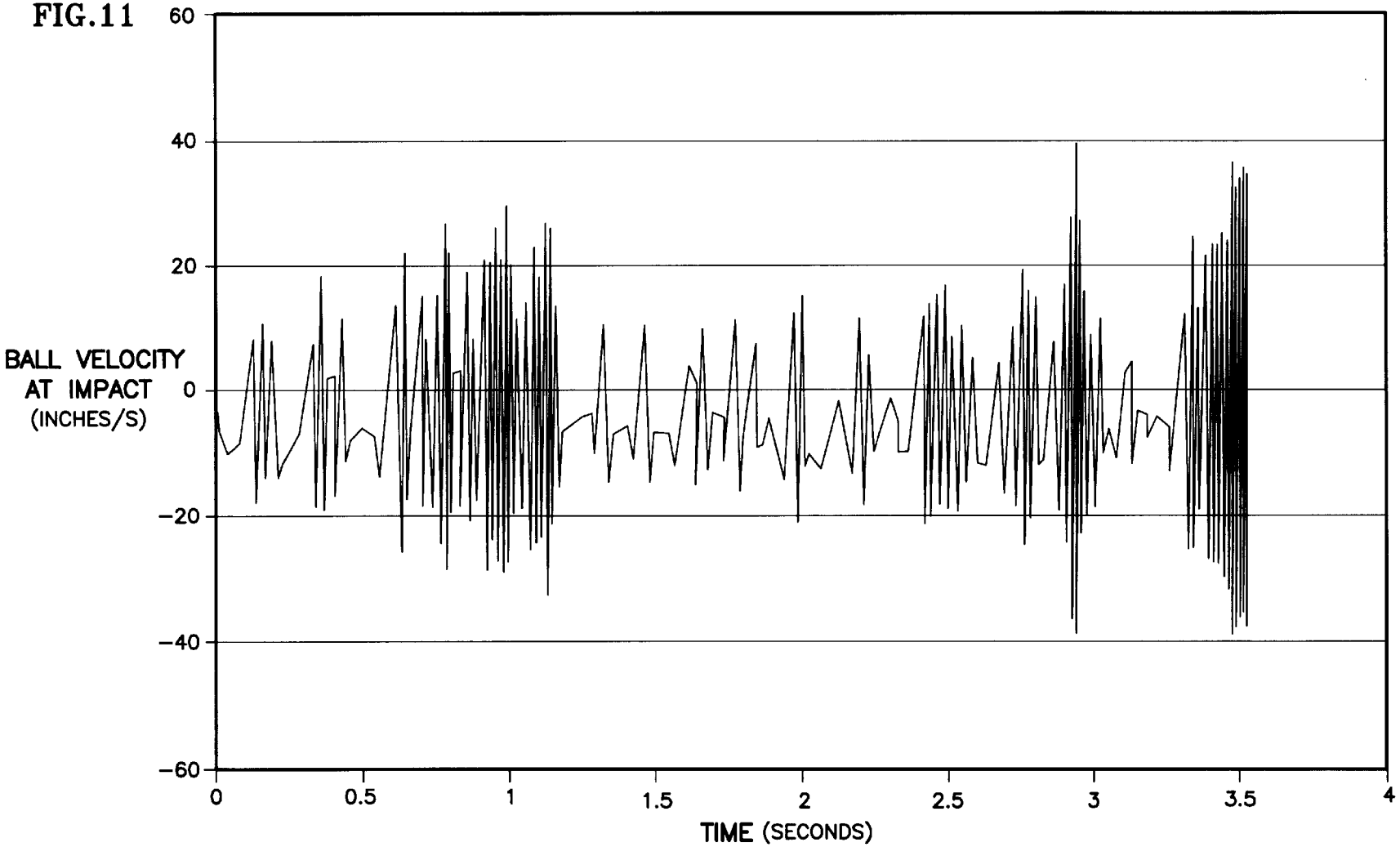
FIG. 11 is a graphical representation of the modeling results illustrating the velocity of the peening element as a function of time while the hollow part, having a cavity height of 0.25 inches, vibrates at a frequency equal to 400 Hz and an acceleration equal to 30 gs.

This is further substantiated by FIG. 11 which is a plot illustrating the velocity of the peening element 14 as a function of time when all other parameters are held constant and the vibration frequency is increased to 400 Hz. Increasing the vibration frequency to 400 Hz fails to cause the peening element to impact the top and bottom surfaces 28, 26 at a constant rate or constant velocity. It is important that the peening element 14 contact the internal surface(s) of a hollow part 12 at a constant rate and steady velocity because it is known that peening a surface at a certain velocity induces desired compressive residual stresses. In order to effectively determine the compressive residual stress level on the internal surface of the hollow part, the peening element 14 must contact the top and bottom surfaces 28, 26 at the desired velocities.

The inventors of the present invention have, therefore, devised a method to determine the cut-off frequency at which to vibrate a hollow part 12 in order to peen its internal surface(s). The inventors of the present invention utilized the peening apparatus 10 of FIG. 1 to determine the cut-off vibration frequency at which to vibrate hollow parts 12 for different cavity heights (h). Included within the peening apparatus 10 was an accelerometer 22, which was affixed to the clamp 16 in order to determine the acceleration of the hollow part 12 vibrated. Although the accelerometer 22 was affixed to the clamp 16, the accelerometer 22 could have been affixed to any portion of the peening apparatus 10. Also included within the peening apparatus 10 was an acoustic sensor 24, which was affixed to the hollow part 12 in order to sense the impact between the peening elements 14 and the internal top surface 28 of the hollow part 12. In this instance, the acoustic sensor 24 was an acoustic emission sensor but could be comprised of other known acoustic sensing devices.

The method for determining the cut-off frequency at which to vibrate the hollow part 12 when peening its internal surface comprised the steps of inserting at least one peening element 14 into the hollow part, vibrating the hollow part at a constant sinusoidal acceleration, vibrating the hollow part 12 at a vibration frequency such that the peening element 14 impacts the internal surface at a rate equal to the vibration frequency, sensing the impact rate between the peening element 14 and the internal surface, and altering the vibration frequency until the impact rate is less than the vibration frequency. The cut-off frequency being the vibration frequency just prior to the impact rate becoming less than the vibration frequency. In other words, when the peening element 14 contacted the internal surface at a rate equal to the vibration frequency, then the ratio of the impact rate to the vibration frequency was one (1). Once the vibration frequency was altered such that the impact rate was less than the vibration frequency, then the ratio was less than one. Although altering the vibration frequency typically involves increasing the vibration frequency, altering may also include decreasing the vibration frequency.

For example, after inserting the peening elements 14 into the hollow part 12, the shaker 20 begins to vibrate at a vibration frequency and an acceleration, which are measured by an accelerometer 22 that is affixed to the shaker 20 on hollow part 12. The accelerometer 22 measures the acceleration at which the hollow part 12 vibrates and converts the acceleration to a vibration amplitude because, as mentioned above, the vibration amplitude is equal to the quotient of the acceleration divided by the square of the vibration frequency. The acoustic sensor 24 thereafter senses the impact between the peening elements 14 and the internal top surface 28. If the peening elements 14 initially fail to impact the internal top surface 28 at a rate equal to the vibration frequency, then the vibration frequency is altered (i.e., increased or decreased) until the peening elements 14 impact the internal top surface 28 at a rate equal to the vibration frequency. Once the impact rate equals the vibration frequency, the vibration frequency is increased until the periodic rate at which the peening element 14 impacts the internal top surface 28 is less than the vibration frequency. The cut-off frequency is the vibration frequency just prior to when the impact rate begins to become less than the vibration frequency. Although the vibration frequency was increased to determine the optimum vibration frequency, the vibration frequency could also be decreased to determine the cut-off frequency.

Upon determining the cut-off vibration frequency, the maximum velocity of the hollow part is determined for such cut-off frequency. The maximum velocity of the hollow part is calculated by multiplying the vibration frequency times the vibration amplitude, which was determined from sensing the acceleration of the hollow part discussed herein before.

The maximum velocity of the peening element is also determined for the cut-off frequency. Because the peening element 14 travels a distance of two times the cavity height (h) less the diameter of the peening element (d) in one vibration cycle, the peening element 14 achieves a maximum velocity of about:

$$V_{pe}=2\,[|A\cos\Phi_1-A\cos\Phi_2|+(h-d)]f \qquad \text{[Eq. 8]}$$

where,

A=vibration amplitude $\Phi_1$=phase angle at impact with top internal surface $\Phi_2$=phase angle at impact with bottom internal surface h=cavity height d=diameter of peening element $f$=vibration frequency Assuming that the vibration amplitude (A) is negligible in comparison to the difference between the cavity height (h) and peening element diameter (d), the peening element's maximum velocity can be determined according to the following equation:

$$V_{pe}=2\,(h-d)f \qquad \text{[Eq. 9]}$$

The cut-off frequency, however, is a function of the peening element's diameter and the hollow part's cavity height and acceleration. In order to determine the relationship between these elements, the cavity height remains constant and the cut-off frequency was ascertained for various accelerations. Referring to Table 1, the cut-off frequency was ascertained for a 0.04 inch diameter peening element and a hollow part having a cavity height of 0.25 and vibrating at 10 g's, 20 g's, 30 g's, 55 g's, and 80 g's.

TABLE 1

| Cavity Height (inches) | Acceleration (gs) | Cut-Off Frequency (Hz) | Vibration Amplitude (inches) | Velocity of Peening Element $V_{pe}$ (inches/sec) | Velocity of Hollow Part $V_p$ (inches/sec) |
|---|---|---|---|---|---|
| 0.25 | 10 | 80 | 0.0153 | 33.6 | 7.7 |
| 0.25 | 20 | 158 | 0.0078 | 66.4 | 7.8 |
| 0.25 | 30 | 195 | 0.0077 | 81.9 | 9.5 |
| 0.25 | 55 | 231 | 0.0010 | 97.0 | 14.6 |
| 0.25 | 80 | 300 | 0.0087 | 126.0 | 16.4 |

The vibration amplitude is equal to the acceleration divided by the square of the cut-off frequency, per Eq. 6. The velocity of the peening element is calculated according to Eq. 7. The velocity of the hollow part is determined by the accelerometer.

The same process used to determine the cut-off frequency for a hollow part having a 0.25 inch cavity height and vibrating at various accelerations was also performed for a hollow part having a 0.75 cavity height. The results of determining the cut-off frequency for a hollow part 12 having a cavity height (h) of 0.75 inches are illustrated in Table 2.

TABLE 2

| Cavity Height (inches) | Acceleration (gs) | Cut-Off Frequency (Hz) | Vibration Amplitude (inches) | Velocity of Peening Element $V_{pe}$ (inches/sec) | Velocity of Hollow Part $V_p$ (inches/sec) |
|---|---|---|---|---|---|
| 0.75 | 10 | 55 | 0.0323 | 78.1 | 11.2 |
| 0.75 | 20 | 77 | 0.0330 | 109.3 | 16.0 |
| 0.75 | 30 | 90 | 0.0362 | 127.8 | 20.5 |
| 0.75 | 55 | 127 | 0.0333 | 280.3 | 26.6 |
| 0.75 | 80 | 153 | 0.0334 | 217.4 | 32.1 |

Figure 12:
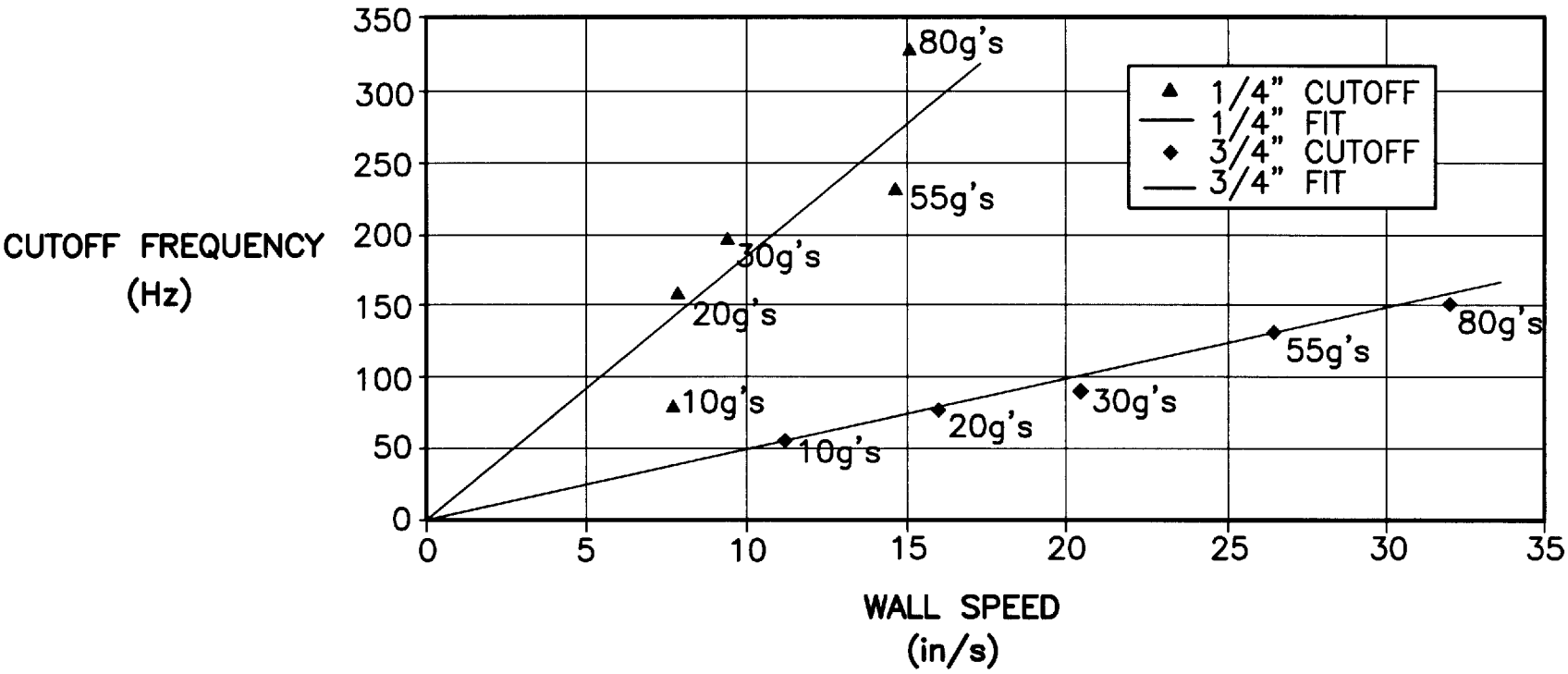
FIG. 12 is a graph illustrating the relationship between the cut-off frequency and the velocity of the hollow part.
Figure 13:
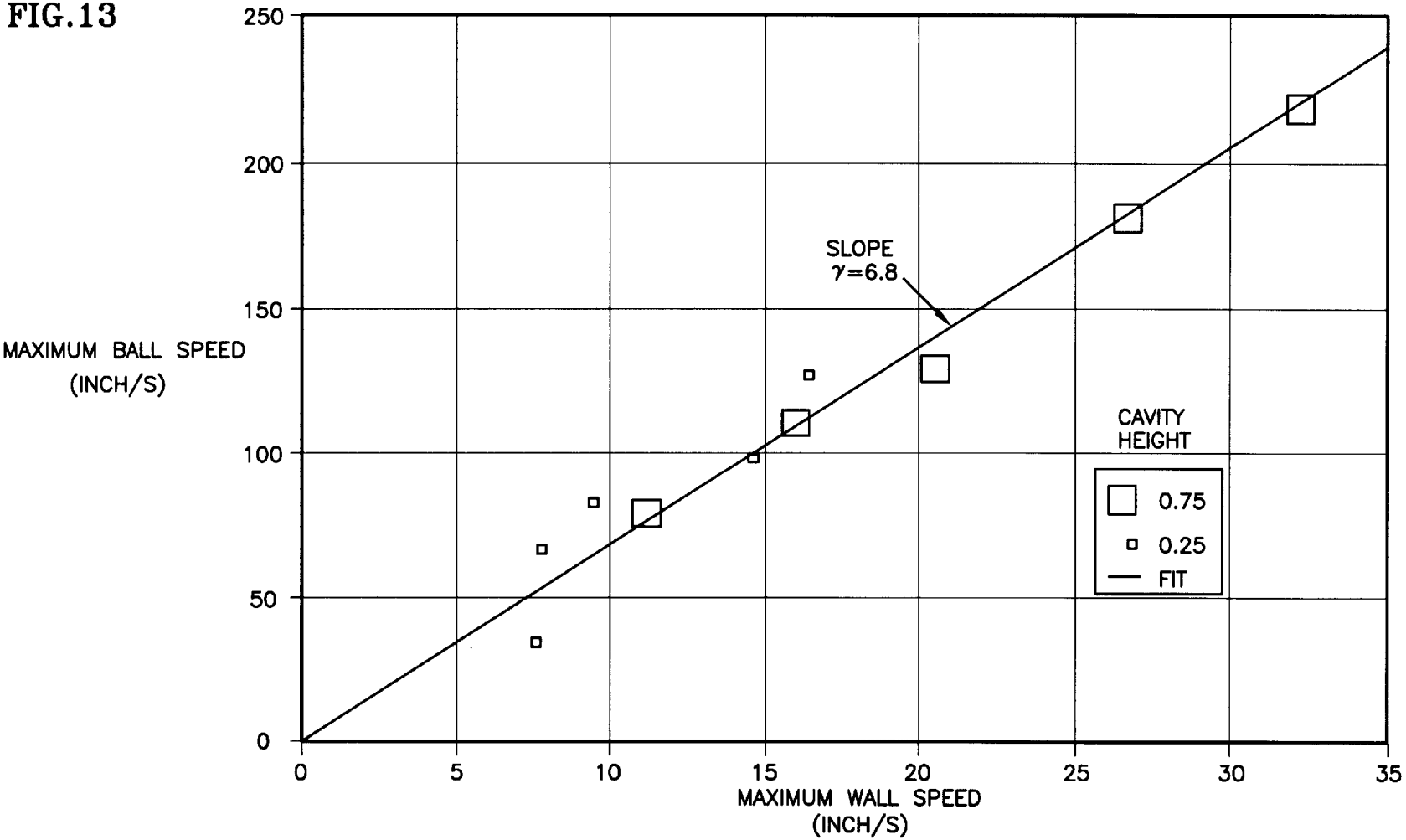
FIG. 13 is a graph illustrating the relationship between the velocity of the peening element and the velocity of the hollow part.

Referring to FIG. 12 there is shown a graph that plots the cut-off frequency versus the velocity of the hollow part from tabular information listed in Tables 1 and 2. The points designated by a "▲" relate to the data in Table 1, and the points designated by a "◆" relate to the data in Table 2. As evidenced by this figure, the inventors of the present invention have discovered that there is a direct relationship between the velocity of the hollow part and the cut-off vibration frequency. By plotting the velocity of the peening element versus the velocity of the hollow part, as seen in FIG. 13, the inventors of the present invention recognized a direct relationship for these two variable. The direct relationship between the velocity of the peening element and the velocity of the hollow part is the slope of the curve, which is hereinafter referred to as the peening element speed limit ratio (γ). In order to calculate the peening element speed limit ratio, the difference between two peening element velocities is divided by the difference of the corresponding hollow part velocities.

Specifically, the peening element speed limit ratio (γ) is as follows:

$$\gamma = \frac{V_{pe2} - V_{pe1}}{V_{p2} - V_{p1}} \quad \text{[Eq. 10]}$$

Therefore, when the peening element 14 contacts the internal wall of the hollow part 12 at a periodic rate, the velocity of the peening element ($V_{pe}$) is as follows:

$$V_{pe}=\gamma V_{hp} \quad \text{[Eq. 11]}$$

where $V_{hp}$=velocity of the hollow part.

The acceleration of the hollow part 12 is equal to the product of the angular frequency (ω) and the velocity of the hollow part ($V_{hp}$) which is expressed in the following formula:

$$a_{hp}=\omega V_{hp} \quad \text{[Eq. 12]}$$

The angular frequency (ω) can also be expressed according to the following formula:

$$\omega=2\pi f \quad \text{[Eq. 13]}$$

Replacing ω in Eq. 12 with its formulaic equivalent in Eq. 13 produces the following formula:

$$a_{hp}=2\pi f V_{hp} \quad \text{[Eq. 14]}$$

Additionally, replacing $V_{hp}$ in Eq. 14 with its formulaic equivalent in Eq. 11 produces the following equation:

$$a_{hp}=2\pi f V_{pe}/\gamma \quad \text{[Eq. 15]}$$

Furthermore, replacing $f$ in Eq. 15 with its formulaic equivalent in Eq. 9 produces the following equation:

$$a_{hp}=\pi V_{pe}^2/(h-d)\gamma \quad \text{[Eq. 16]}$$

As mentioned above, the peening element velocity ($V_{pe}$) required to induce certain compressive residual stresses is known, but the acceleration and vibration frequency at which to vibrate the hollow part to induce such compressive residual stresses is not known. Once the peening element speed limit ratio (γ) is calculated, an operator of a peening apparatus can utilize Eq. 16 to determine the required acceleration at which to vibrate the hollow part in order to induce the desired compressive residual stresses. In other words, as long as the acceleration is greater than or equal to $\pi V_{pe}^2/(h-d)\gamma$, then the desired compressive residuals will be imparted. Furthermore, the vibration frequency at which to vibrate the hollow part in order to induce such compressive residual stresses is equal to the desired velocity of the peening element developed by twice the distance of the effective cavity height, wherein the effective cavity height is the actual cavity height (h) minus the diameter (d) of the peening element.

The inventors of the present invention have also recognized a relationship between the speed limit ratio (γ) and the coefficient of restitution (ε). The relationship is expressed according to the following formula:

$$\gamma = \left(\frac{1+\varepsilon}{1-\varepsilon}\right)\sin\phi 1 - \frac{\sin\phi 2}{2} \quad \text{[Eq. 17]}$$

where, $\Phi_1$=phase angle at impact with top internal surface $\Phi_2$=phase angle at impact with bottom internal surface Assuming that $\Phi_1$ and $\Phi_2$ are 180° out of phase and that the peening element contacts the internal surfaces and at an impact rate equal to the vibration frequency, then $$\frac{\sin\phi 1 - \sin\phi 2}{2}$$

becomes one (1). Hence, Eq. 17 reduces to the following equation:

$$\gamma = \frac{1-\varepsilon}{1+\varepsilon} \quad \text{[Eq. 18]}$$

Solving for the coefficient of restitution (ε) in eq. 18 is accomplished by rearranging the equation as follows:

$$\varepsilon = \frac{\gamma - 1}{\gamma + 1} \quad \text{[Eq. 19]}$$

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A method for peening the internal surface of a hollow part with at least one peening element therein, the peening element having a diameter (d) and the hollow part having a cavity height (h), comprising the step(s) of: vibrating the hollow part at a vibration frequency (f) equal to about $$\frac{V_{pe}}{2(h-d)}$$

and at an acceleration equal to or greater than about $$\frac{\pi V_{pe}^2}{\gamma(h-d)},$$

wherein $V_{pe}$ is the desired velocity of the peening element and wherein γ is a peening element speed limit ratio and wherein the peening element speed limit ratio (γ) is determined by the method comprising the steps:

(a) vibrating the hollow part at a first constant sinusoidal acceleration and a first vibration frequency such that the impact rate is about equal to the first vibration frequency, wherein the impact rate is a rate of impact between the peening element and an internal surface of the hollow part;

(b) altering the vibration frequency of the hollow part to a first altered vibration frequency until the impact rate is less than the first altered vibration frequency, the vibration frequency immediately prior to the first altered vibration frequency being referred to as a first cut-off frequency;

(c) determining the velocity of the hollow part ($V_{p1}$) commensurate with the first cut-off frequency;

(d) determining the velocity of the peening element ($V_{pe1}$) commensurate with the first cut-off frequency;

(e) vibrating the hollow part at a second constant sinusoidal acceleration and a second vibration frequency such that the impact rate is equal to about the second vibration frequency;

(f) altering the vibration frequency of the hollow part to a second altered vibration frequency until the impact rate is less than the second altered vibration frequency, the vibration frequency immediately prior to the second altered vibration frequency being referred to as a second cut-off frequency;

(g) determining the velocity of the hollow part ($V_{p2}$) commensurate with the second cut-off frequency; and (h) determining the velocity of the peening element ($V_{pe2}$) commensurate with the second cut-off vibration frequency, the peening element speed limit ratio (γ) being equal to $$\frac{V_{pe2} - V_{pe1}}{V_{p2} - V_{p1}}.$$

2. The method of claim 1 further comprising the step of adjusting the acceleration.

3. The method of claim 2 wherein the acceleration is adjusted such that the peening element contacts the internal surface of the hollow part at a rate equal to the vibration frequency.

4. The method of claim 2 wherein the acceleration is adjusted to maintain a constant or relatively constant desired peening element velocity ($V_{pe}$) for a variable cavity height (h).

5. The method of claim 1 further comprising the step of adjusting the vibration frequency.

6. The method of claim 5 wherein the vibration frequency is adjusted such that the peening element contacts the internal surface of the hollow part at a rate equal to the vibration frequency.

7. The method of claim 5 wherein the vibration frequency is adjusted to maintain a constant or relatively constant desired peening element velocity ($V_{pe}$) for a variable cavity height (h).

8. The method of claim 1 further comprising the step of adjusting the vibration frequency and the acceleration.

9. The method of claim 8 wherein the vibration frequency and the acceleration are adjusted such that the peening element contacts the internal surface of the hollow part at a rate equal to the vibration frequency.

10. The method of claim 8 wherein the vibration frequency and the acceleration are adjusted to maintain a constant or relatively constant desired peening element velocity ($V_{pe}$) for a variable cavity height (h).

11. The method of claim 1 further comprising the step of continuing to vibrate the hollow part until at least a portion of the internal surface of the hollow part attains a predetermined stress level.

12. The method of claim 1 further comprising the step of adjusting the acceleration such that the acceleration is equal to or greater than about $$\frac{\pi V_p^2}{\gamma(h_2 - d)}$$

for an other cavity height ($h_2$).

13. The method of claim 1 further comprising the step of adjusting the vibration frequency such that the vibration frequency is equal to about $$\frac{V_p}{2(h_2 - d)}$$

for an other cavity height ($h_2$).

14. The method of claim 13 further comprising the step of adjusting the acceleration such that the acceleration is equal to or greater than about $$\frac{\pi V_p^2}{\gamma(h_2 - d)}$$

for said other cavity height ($h_2$).

15. The method of claim 14 further comprising the step of continuing to vibrate the hollow part until at least another portion of the internal surface of the hollow part attains said predetermined stress level.

16. A method for peening the internal surface of a hollow part with at least one peening element therein, the peening element having a diameter (d) and the hollow part having a cavity height (h), comprising the steps of:

(a) vibrating the hollow part at a vibration frequency (f) equal to about $$\frac{V_{pe}}{2(h-d)}$$

and at an acceleration equal to or greater than about $$\frac{\pi V_{pe}^2}{\gamma(h-d)},$$

wherein $V_{pe}$ is the desired velocity of the peening element and wherein γ is a peening element speed limit ratio and wherein the peening element speed limit ratio (γ) is determined by the method comprising the steps:

(1) vibrating the hollow part at a first constant sinusoidal acceleration and a first vibration frequency such that the impact rate is about equal to the first vibration frequency, wherein the impact rate is a rate of impact between the peening element and an internal surface of the hollow part;

(2) altering the vibration frequency of the hollow part to a first altered vibration frequency until the impact rate is less than the first altered vibration frequency, the vibration frequency immediately prior to the first altered vibration frequency being referred to as a first cut-off frequency;

(3) determining the velocity of the hollow part ($V_{p1}$) commensurate with the first cut-off frequency;

(4) determining the velocity of the peening element ($V_{pe1}$) commensurate with the first cut-off frequency;

(5) vibrating the hollow part at a second constant sinusoidal acceleration and a second vibration frequency such that the impact rate is equal to about the second vibration frequency;

(6) altering the vibration frequency of the hollow part to a second altered vibration frequency until the impact rate is less than the second altered vibration frequency, the vibration frequency immediately prior to the second altered vibration frequency being referred to as a second cut-off frequency;

(7) determining the velocity of the hollow part ($V_{p2}$) commensurate with the second cut-off frequency; and (8) determining the velocity of the peening element ($V_{pe2}$) commensurate with the second cut-off vibration frequency, the peening element speed limit ratio (γ) being equal to $$\frac{V_{pe2}-V_{pe1}}{V_{p2}-V_{p1}};$$

(b) continuing to vibrate and accelerate the hollow part until at least a portion of the internal surface of the hollow part attains a predetermined stress level;

(c) adjusting the vibration frequency such that the vibration frequency is equal to about $$\frac{V_p}{2(h_2-d)}$$

for an other cavity height ($h_2$);

(d) adjusting the acceleration such that the acceleration is equal to or greater than about $$\frac{\pi V_p^2}{\gamma(h_2-d)}$$

for said other cavity height ($h_2$); and (e) continuing to vibrate the hollow part until at least said other portion of the internal surface of the hollow part attains said predetermined stress level.

17. A method for peening the internal surface of a hollow part with at least one peening element therein, the peening element having a diameter (d) and the hollow part having a cavity height (h), comprising the step(s) of: vibrating the hollow part at a vibration frequency (f) equal to about $$\frac{V_{pe}}{2(h-d)}$$

and at an acceleration equal to or greater than about $$\frac{\pi V_{pe}^2}{\gamma(h-d)},$$

wherein $V_{pe}$ is the desired velocity of the peening element and wherein γ is a peening element speed limit ratio and wherein the peening element speed limit ratio (γ) is determined by the method comprising the steps:

(a) vibrating the hollow part at a first constant sinusoidal acceleration and a first vibration frequency such that the ratio of the impact rate to the first vibration frequency is equal to about 1, wherein the impact rate is rate of impact between the peening element and an internal surface of the hollow part;

(b) altering the vibration frequency of the hollow part to a first altered vibration frequency until the ratio of the impact rate to the first altered vibration frequency is less than about 1, the vibration frequency immediately prior to the ratio of the impact rate to the first altered vibration frequency being referred to as a first cut-off frequency;

(c) determining the velocity of the hollow part ($V_{p1}$) commensurate with the first cut-off frequency;

(d) determining the velocity of the peening element ($V_{pe1}$) commensurate with the first cut-off frequency;

(e) vibrating the hollow part at a second constant sinusoidal acceleration and a second vibration frequency such that the ratio of the impact rate to the second vibration frequency is equal to about 1;

(f) altering the vibration frequency of the hollow part to a second altered vibration frequency until the ratio of the impact rate to the second altered vibration frequency is less than 1, the vibration frequency immediately prior to the ratio of the impact rate to the second altered vibration frequency being less than 1 being referred to as a second cut-off frequency;

(g) determining the velocity of the hollow part ($Vp_2$) commensurate with the second cut-off frequency; and (h) determining the velocity of the peening element ($V_{pe2}$) commensurate with the second cut-off vibration frequency, the peening element speed limit ratio (γ) being equal to $$\frac{V_{pe2}-V_{pe1}}{V_{p2}-V_{p1}}.$$

18. The method of claim 17 further comprising the step of adjusting the acceleration.

19. The method of claim 18 wherein the acceleration is adjusted such that the peening element contacts the internal surface of the hollow part at a rate equal to the vibration frequency.

20. The method of claim 18 wherein the acceleration is adjusted to maintain a constant or relatively constant desired peening element velocity ($V_{pe}$) for a variable cavity height (h).

21. The method of claim 17 further comprising the step of adjusting the vibration frequency.

22. The method of claim 21 wherein the vibration frequency is adjusted such that the peening element contacts the internal surface of the hollow part at a rate equal to the vibration frequency.

23. The method of claim 21 wherein the vibration frequency is adjusted to maintain a constant or relatively constant desired peening element velocity ($V_{pe}$) for a variable cavity height (h).

24. The method of claim 17 further comprising the step of adjusting the vibration frequency and the acceleration.

25. The method of claim 24 wherein the vibration frequency and the acceleration are adjusted such that the peening element contacts the internal surface of the hollow part at a rate equal to the vibration frequency.

26. The method of claim 24 wherein the vibration frequency and the acceleration are adjusted to maintain a constant or relatively constant desired peening element velocity ($V_{pe}$) for a variable cavity height (h).

27. The method of claim 17 further comprising the step of continuing to vibrate the hollow part until at least a portion of the internal surface of the hollow part attains a predetermined stress level.

28. The method of claim 18 further comprising the step of adjusting the acceleration such that the acceleration is equal to or greater than about $$\frac{\pi V_p^2}{\gamma(h_2-d)}$$

for an other cavity height ($h_2$).

29. The method of claim 17 further comprising the step of adjusting the vibration frequency such that the vibration frequency is equal to about $$\frac{V_p}{2(h_2-d)}$$

for an other cavity height ($h_2$).

30. The method of claim 29 further comprising the step of adjusting the acceleration such that the acceleration is equal to or greater than about $$\frac{\pi V_p^2}{\gamma(h_2-d)}$$

for said other cavity height ($h_2$).

31. The method of claim 30 further comprising the step of continuing to vibrate the hollow part until at least another portion of the internal surface of the hollow part attains said predetermined stress level.

32. A method for peening the internal surface of a hollow part with at least one peening element therein, the peening element having a diameter (d) and the hollow part having a cavity height (h), comprising the step(s) of:

(a) vibrating the hollow part at a vibration frequency (*f*) equal to about $$\frac{V_{pe}}{2(h-d)}$$

and at an acceleration equal to or greater than about $$\frac{\pi V_{pe}^2}{\gamma(h-d)},$$

wherein $V_{pe}$ is the desired velocity of the peening element and wherein γ is a peening element speed limit ratio and wherein the peening element speed limit ratio (γ) is determined by the method comprising the steps:

(1) vibrating the hollow part at a first constant sinusoidal acceleration and a first vibration frequency such that the ratio of the impact rate to the first vibration frequency is equal to about 1, wherein the impact rate is rate of impact between the peening element and an internal surface of the hollow part;

(2) altering the vibration frequency of the hollow part to a first altered vibration frequency until the ratio of the impact rate to the first altered vibration frequency is less than about 1, the vibration frequency immediately prior to the ratio of the impact rate to the first altered vibration frequency being referred to as a first cut-off frequency;

(3) determining the velocity of the hollow part ($V_{p1}$) commensurate with the first cut-off frequency;

(4) determining the velocity of the peening element ($V_{pe1}$) commensurate with the first cut-off frequency;

(5) vibrating the hollow part at a second constant sinusoidal acceleration and a second vibration frequency such that the ratio of the impact rate to the second vibration frequency is equal to about 1;

(6) altering the vibration frequency of the hollow part to a second altered vibration frequency until the ratio of the impact rate to the second altered vibration frequency is less than 1, the vibration frequency immediately prior to the ratio of the impact rate to the second altered vibration frequency being less than 1 being referred to as a second cut-off frequency;

(7) determining the velocity of the hollow part ($Vp_2$) commensurate with the second cut-off frequency; and (8) determining the velocity of the peening element ($V_{pe2}$) commensurate with the second cut-off vibration frequency, the peening element speed limit ratio ($\gamma$) being equal to $$\frac{V_{pe2} - V_{pe1}}{V_{p2} - V_{p1}};$$

(b) continuing to vibrate and accelerate the hollow part until at least a portion of the internal surface of the hollow part attains a predetermined stress level;

(c) adjusting the vibration frequency such that the vibration frequency is equal to about $$\frac{V_p}{2(h_2 - d)}$$

for an other cavity height ($h_2$);

(d) adjusting the acceleration such that the acceleration is equal to or greater than about $$\frac{\pi V_p^2}{\gamma(h_2 - d)}$$

for said other cavity height ($h_2$); and (e) continuing to vibrate the hollow part until at least said other portion of the internal surface of the hollow part attains said predetermined stress level.

* * * * *